US005401185A

United States Patent [19]

Wang et al.

[11] Patent Number: 5,401,185

[45] Date of Patent: Mar. 28, 1995

[54] EDGE CONNECTOR

[76] Inventors: Kuo-Long Wang, 11F-2, No. 30, Nan King West Rd.; Su-Pei Yang, 2F, No. 110, Lane 103, Sec. 2, Nei-Hu Rd., both of Taipei, Taiwan, Prov. of China

[21] Appl. No.: 155,285

[22] Filed: Nov. 22, 1993

[51] Int. Cl.[6] ..... H01R 4/24

[52] U.S. Cl. ..... 439/441; 439/637

[58] Field of Search ..... 439/630–637, 439/326–328, 438–441

[56] References Cited

U.S. PATENT DOCUMENTS

| | | | |
|---|---|---|---|
| 3,015,083 | 12/1981 | Juris | 439/637 |
| 3,149,899 | 9/1964 | Johanson | 439/637 |
| 3,422,394 | 1/1969 | Antes | 439/637 |
| 3,587,029 | 6/1971 | Knowles | 439/637 |

*Primary Examiner*—David L. Pirlot

*Attorney, Agent, or Firm*—Wenderoth, Lind & Ponack

[57] ABSTRACT

An edge connector includes a shell having two symmetrical rows of vertical slots. Each of the vertical slots is formed of an upper space and a lower space linked together to hold a metal contact spring plate and a conductor clamp. The metal contact spring plate includes a bent portion in the middle and disposed between the upper and lower spaces, a projecting strip stopped above the lower space, a curved clamping portion at one end received in the upper space for making an electric contact with an external connector, a wedge portion at an opposite end vertically received in the lower space and terminating in a sloping tail. The conductor clamp has a first bent portion and a second bent portion stopped within the lower space at two opposite locations, a rear end disposed over a front end thereof and stopped against the wedge portion of the metal contact spring plate for clamping a conductor against the metal contact spring plate.

12 Claims, 6 Drawing Sheets

EDGE CONNECTOR

BACKGROUND OF THE INVENTION

The present invention relates to an edge connector, comprising a shell having a plurality of slots, a metal contact spring plate and a conductor clamp provided in one or more of the slots in the shell, which allows for quick installation of conductors thereinto.

A conventional edge connector for use in TV game machines, as shown in FIG. 8, is generally comprised of a shell (10) having rows of contact mounting slots (101), a plurality of contacts (20) respectively mounted within the contact mounting slots (101), and a plurality of conductors (30) respectively connected to the connecting portions of the contacts (20). This structure of edge connector is complicated to manufacture. Because the conductors are separately soldered to the contacts, it is difficult to maintain a high quality. FIG. 9 shows another structure of an edge connector according to the prior art, in which each of the conductors (30) is fastened to a contact (not shown) by a conductor clamp (40). A rear end of the conductor clamp (40) includes two opposite binding strips (401, 402), which are bent to hold down the conductor, and a front end of the conductor clamp to a curved spring leaf (403), which fastens to the circuit board. This structure of the edge connector eliminates the process of tin soldering. However, fastening the conductor clamp is not an easy job, and a special machine is needed to carry out such fastening work.

SUMMARY OF THE INVENTION

The present invention has been accomplished under the aforesaid circumstances. It is therefore an object of the present invention to provide a metal contact spring plate and a conductor clamp which can be conveniently and quickly inserted and then positioned in any slot in the shell of the edge connector. It is another object of the present invention to provide a metal contact spring plate and a conductor clamp for an edge connector which can be conveniently mounted within any slot in the shell of the edge connector to hold down a conductor upon its insertion. It is still another object of the present invention to provide a shell for an edge connector which has horizontal slots on two opposite sides thereof, respectively linked to vertical slots thereof, to allow for insertion of a rod into one of the horizontal slots to release the conductor from the conductor clamp in the vertical slot linked to the horizontal slot.

DETAILED DESCRIPTION OF THE PREFERRED EMBODIMENT

Figure 1:
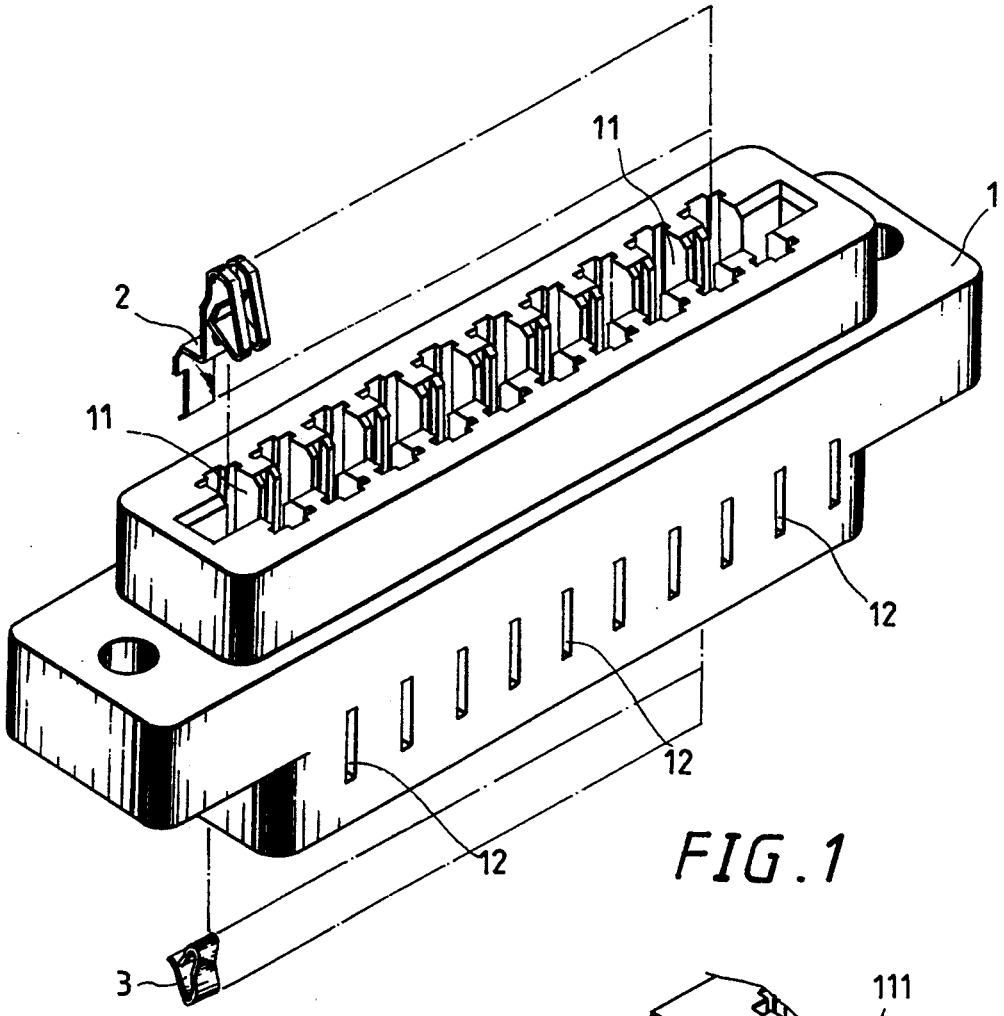
FIG. 1 is an exploded view of an edge connector according to a preferred embodiment of the present invention.
Figure 2:
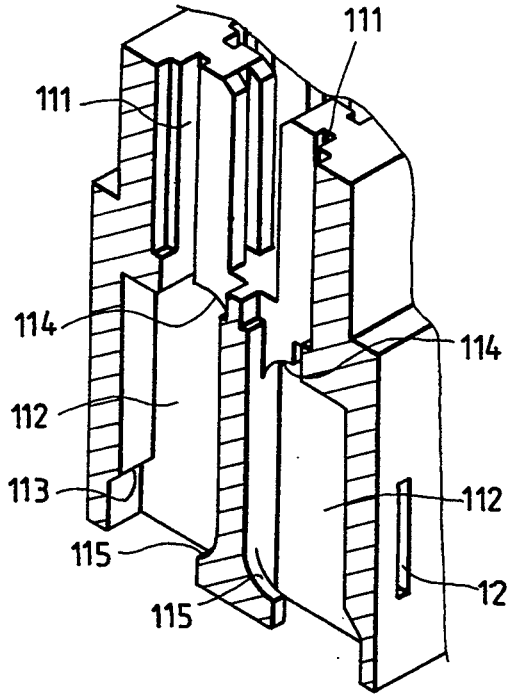
FIG. 2 is a sectional elevation of a shell of the edge connector shown in FIG. 1.

Referring to FIGS. 1 and 2, the shell 1 of an edge connector in accordance with the present invention comprises two symmetrical rows of vertical slots 11. Each vertical slot 11 is formed of an upper space 111 and a lower space 112 vertically linked for positioning a metal contact spring plate 2 and a conductor clamp 3, respectively.

Figure 3:
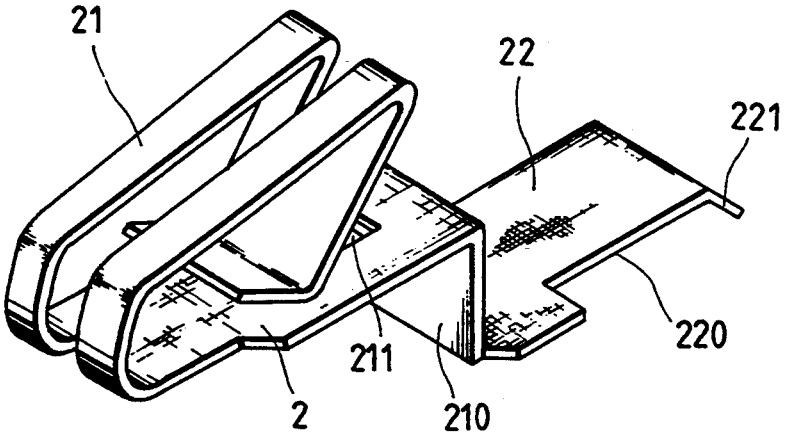
FIG. 3 is an elevational view of a metal contact spring plate according to the present invention.

The metal contact spring plate 2, as shown in FIG. 3, comprises a bent portion 210 in the middle, a projecting strip 211 projected from the square bent portion 210 and formed by punching, a curved clamping portion 21 at one end, and a wedge portion 22 at an opposite end and terminating in a tail 221 and having a side opening 220.

Figure 4:
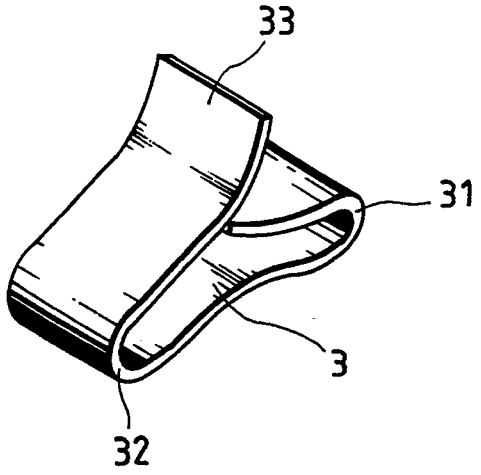
FIG. 4 is an elevational view of a conductor clamp according to the present invention.

The conductor clamp 3, as shown in FIG. 4, is made by bending an elongated spring plate into two opposite substantially U-shaped bent portions 31, 32 with a middle portion therebetween, and such that the first end thereof terminates beneath the second end 33 thereof (i.e. the first end is interposed between the second end 33 and the middle portion of the clamp 3).

Figure 5:
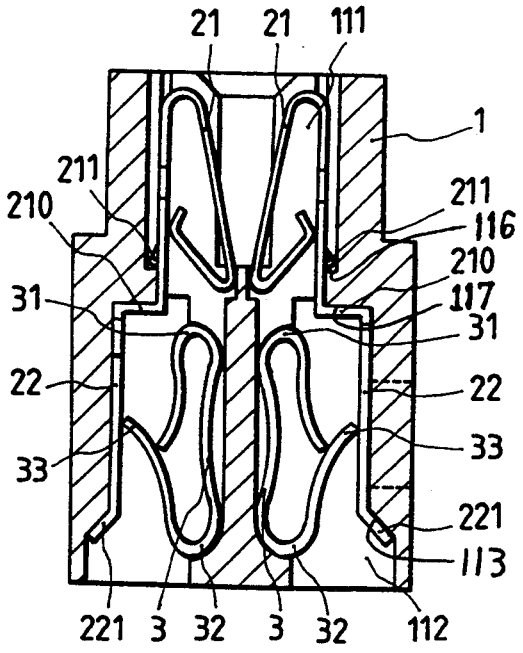
FIG. 5 is a sectional assembly view of the edge connector shown in FIG. 1 before connection of conductors thereto.
Figure 6:
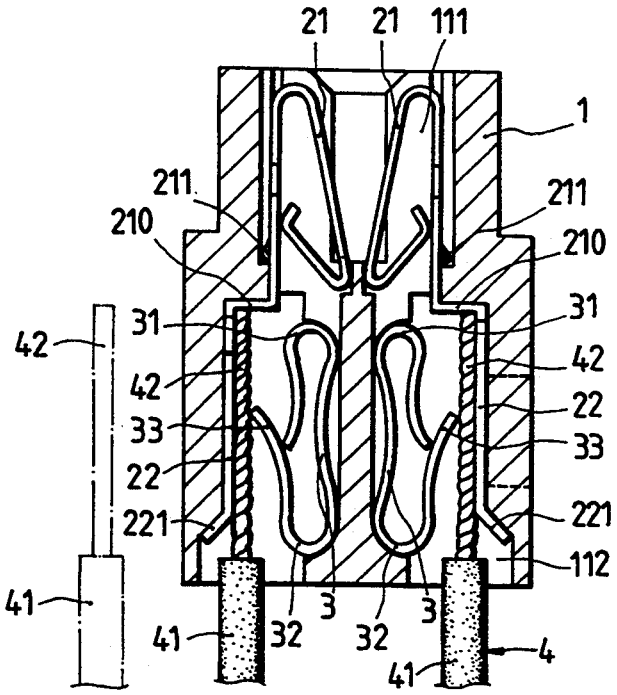
FIG. 6 is similar to FIG. 5 but showing the edge connector with the conductors installed.
Figure 7:
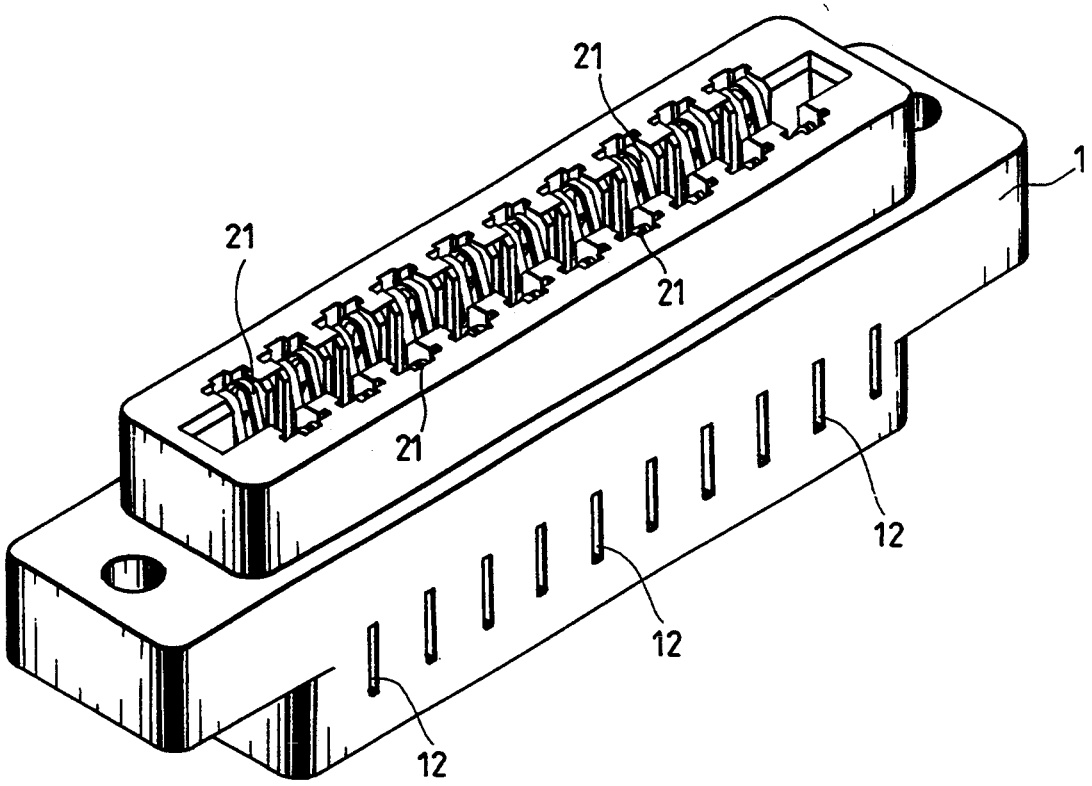
FIG. 7 is a perspective view of the edge connector of FIG. 1.
Figure 8:
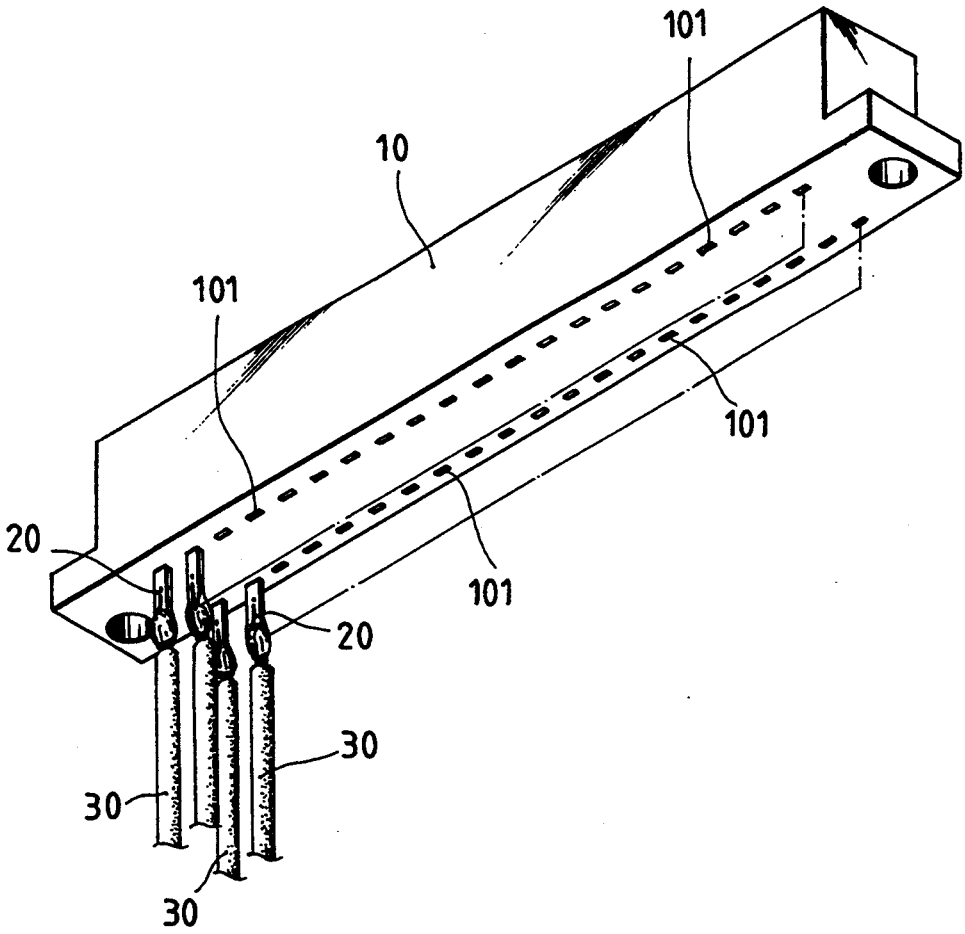
FIG.8 PRIOR ART
FIG. 8 shows a structure of an edge connector according to the prior art.
Figure 9:
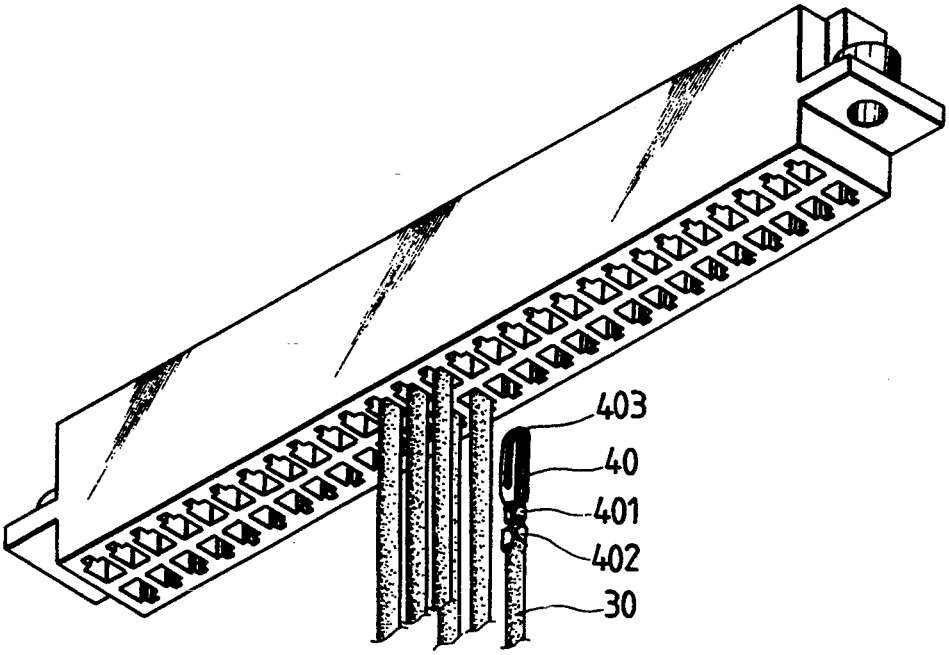
FIG.9 PRIOR ART
FIG. 9 shows another structure of an edge connector according to the prior art.

Referring to FIGS. 5 and 6, as the metal contact spring plate 2 is inserted into either vertical slot 11 of the shell 1 from the bottom, the clamping portion 21 is retained in the upper space 111, bent portion 210 is engaged with a stepped portion 117, the projecting strip (or engagement projection) 211 is stopped above the lower space 112 by a stepped engaging portion 116, and the wedge portion 22 is received in the lower space 112 with the tail 221 closely attached to a sloping wall 113 within the lower space 112 at the bottom (see FIG. 5). As the conductor clamp 3 is inserted into the lower space 112 of either vertical slot 11, the two opposite bent portions 31, 32 are respectively stopped at two curved edges 114, 115 in two diagonal corners within the lower space 112. When installed, the rear end 33 of the conductor clamp 3 stops against the wedge portion 22 of the metal contact spring plate 2. Then, the insulator 41 of the electrical wire 4 is cut off at a suitable length so that the bare conductor 42 of the electrical wire 4 is directly inserted into the lower space 112 along the tail 221 of the metal contact spring plate 2. After the bare conductor 42 of the electrical wire 4 has passed through the gap between the wedge portion 22 of the metal contact spring plate 2 and the rear end 33 of the conductor clamp 3, it will then be stopped by the bent portion 210 of the metal contact spring plate 2. As the front end of the bare conductor 42 of the electrical wire 4 is stopped against the bent portion 210 of the metal contact spring plate 2, it becomes firmly retained between the conductor clamp 3 and the metal contact spring plate 2. Therefore, the assembly process is quite simple.

Referring to FIGS. 1 and 2 again, the shell 1 further comprises two rows of horizontal slots (or tool-insertion openings) 12 on two opposite sides thereof respectively linked to either vertical slot 11. A rod can be inserted into the horizontal slot 12 so that it passes through the side opening 220 of the wedge portion 22 of the respective metal contact spring plate 2, in order to release the respective conductor clamp 3 from the bare conductor 42 of the respective electrical wire 4. In this manner, the respective electrical wire 4 can be easily removed from the shell 1.

What is claimed is:

1. An edge connector comprising:

a shell having a plurality of slots formed therein, each of said slots including an upper space and a lower space opening into said upper space, a stepped portion being formed in said shell between said upper space and said lower space of each of said slots, a first curved corner being defined at one side of said lower space of each of said slots, and a second curved corner disposed above said first curved corner and being defined at said one side of said lower space of each of said slots;

a plurality of metal contact spring plates, each of said spring plates being mounted in one of said slots and having upper and lower end portions, a curved clamping portion at said upper end portion, a wedge portion at said lower end portion, and a bent portion intermediate said upper and lower end portions;

a plurality of conductor clamps respectively mounted in said lower spaces of said slots in which said metal contact spring plates are mounted, each of said conductor clamps having a first end portion terminating in a first end, a second end portion terminating in a second end and a middle portion between said first and second end portions, said first end portion having a first substantially U-shaped bent portion and said second end portion having a second substantially U-shaped bent portion such that each of said first and second ends is disposed adjacent said middle portion with said first end being interposed between said middle portion and said second end;

wherein for each of said spring plates mounted in one of said slots, said upper end portion is mounted in said upper space, said bent portion is engaged with said stepped portion, and said lower portion is mounted in said lower space at a second side thereof opposite said first side thereof; and wherein for each of said conductor clamps mounted in said lower space of one of said slots, said first substantially U-shaped bent portion is engaged with said first curved corner and said second substantially U-shaped bent portion is engaged with said second curved corner.

2. An edge connector as recited in claim 1, wherein an engaging portion is defined in said upper space of each of said slots; and each of said spring plates includes an engagement projection above said bent portion, said engagement projection being engaged with said engaging portion of a respective-one of said upper spaces.

3. An edge connector as recited in claim 1, wherein each of said slots has a sloping edge defined at a lower end of said lower space at said second side thereof; and each of said spring plates includes, at a lower end of said wedge portion thereof, a tail sloping outwardly and downwardly and engaged with said sloping edge of a respective one of said lower spaces.

4. An edge connector as recited in claim 1, wherein said shell has a plurality of horizontal tool-insertion openings formed therein from said lower spaces, respectively, to an exterior of said shell; and said wedge portion of each of said spring plates has a side opening formed therein and aligned with a respective one of said horizontal openings.

5. An edge connector as recited in claim 1, wherein said plurality of slots are provide in said shell in two symmetrical rows.

6. An edge connector as recited in claim 1, wherein said conductor clamps are separate and discrete elements relative to said spring plates, respectively.

7. An edge connector as recited in claim 6, wherein an engaging portion is defined in said upper space of each of said slots; and each of said spring plates includes an engagement projection above said bent portion, said engagement projection being engaged with said engaging portion of a respective one of said upper spaces.

8. An edge connector as recited in claim 7, wherein each of said slots has a sloping edge defined at a lower end of said lower space at said second side thereof; and each of said spring plates includes, at a lower end of said wedge portion thereof, a tail sloping outwardly and downwardly and engaged with said sloping edge of a respective one of said lower spaces.

9. An edge connector as recited in claim 8, wherein said shell has a plurality of horizontal tool-insertion openings formed therein from said lower spaces, respectively, to an exterior of said shell; and said wedge portion of each of said spring plates has a side opening formed therein and aligned with a respective one of said horizontal openings.

10. An edge connector as recited in claim 9, wherein said plurality of slots are provided in said shell in two symmetrical rows.

11. An edge connector as recited in claim 1, wherein said lower spaces open downwardly through an exterior of said shell;

said lower spaces constitute means for respectively receiving conductive wires; and said second ends of said conductor clamps constitute means for respectively clamping the conductive wires against said wedge portions of said spring plates.

12. An edge connector as recited in claim 11, wherein said shell has a plurality of horizontal tool-insertion openings formed therein from said lower spaces, respectively, to an exterior of said shell;

said wedge portion of each of said spring plates has a side opening formed therein and aligned with a respective one of said horizontal openings; and said horizontal openings and said side openings together constitute means for allowing a tool to be inserted into said lower spaces of said slots, respectively, and pushed against said second ends of said conductor clamps, respectively, in order to release clamping engagement of said second ends against the conductive wires.

* * * * *